United States Patent [19]

Coleman

[11] 3,968,669

[45] July 13, 1976

[54] BATTERY SAVING KEY CHAIN

[76] Inventor: Berta W. Coleman, 1447 Northeast Expressway, NE., Atlanta, Ga. 30329

[22] Filed: Oct. 14, 1975

[21] Appl. No.: 621,658

[52] U.S. Cl. ..... 70/456 R; 24/3 M; 24/73 A; 70/457

[51] Int. Cl.[2] ..... A47G 29/10

[58] Field of Search ..... 70/456 R, 457; 24/3 M, 24/3 K, 168, 78 A, DIG. 1, DIG. 5; 340/52 D; 220/375

[56] References Cited

UNITED STATES PATENTS

| | | | |
|---|---|---|---|
| 2,218,932 | 10/1940 | Collins | 70/457 |
| 2,248,338 | 7/1941 | Castleman | 24/3 K |
| 2,599,660 | 6/1952 | Poutinen | 70/457 X |
| 2,892,537 | 6/1959 | Schwartz | 70/456 R |
| 3,145,322 | 8/1964 | Yazigi | 340/52 D |
| 3,476,975 | 11/1969 | Brock | 340/52 D |
| 3,621,690 | 11/1971 | Whitcomb | 70/456 R |
| 3,922,895 | 12/1975 | Greenbaum | 70/457 X |

*Primary Examiner*—Roy D. Frazier
*Assistant Examiner*—Robert W. Gibson, Jr.
*Attorney, Agent, or Firm*—Newton, Hopkins & Ormsby

[57] ABSTRACT

A battery saving key chain is disclosed for inhibiting unintentional usage of automobile batteries. The battery saving key chain comprises a capsule having a tubular member with an open end and a cap member dimensioned to removably close the tubular member open end and thereby define a capsule storage space. A flexible elongated connecting member sized for storage within the capsule storage space loosely connects the cap member with the tubular member. Means are provided for suspending one of the capsule members from an automobile headlight control and for linking an automobile ignition key with the other capsule member.

6 Claims, 3 Drawing Figures

BATTERY SAVING KEY CHAIN

BACKGROUND OF THE INVENTION

This invention relates to devices for inhibiting unintentional usage of automobile batteries.

Automotive headlights provide a substantial load upon automobile electrical systems. When the automobile engine is running, the electrical system is normally powered by a generator through suitable voltage regulation means. However, when the engine is shut down the electrical system is powered exclusively by a battery. Though this battery may sustain relatively light system loads for substantial periods of time, the load provided by automobile headlights is too great for this. When, therefore, automobile headlights are left in an energized condition while the engine is shut down, energy is depleted from the battery to a point where the headlights are dimmed or extinguished and the battery rendered incapable of providing sufficient current to restart the engine. This all too frequent occurrence is very frustrating to automobile drivers who, having inadvertently left their headlights on while away from the vehicle for a substantial period of time, return only to find their batteries dead and the engine incapable of being started.

In recent years the just described condition has occurred at an increasing frequent rate due to the fact that many State regulations now require headlights to be on whenever the car is operating in rain as well as during those times when driving visability is reduced as at twilight or at dusk. Prior art attempts have been made alleviating this condition. They, however, have been essentially limited to mechanisms for automatically turning off the headlights when the car ignition is turned off. This approach is successful only with an accompanying sacrifice in headlight control insomuchas there often exists specific periods of time when it is consciously desirable to maintain headlights in an on condition but with the engine in an off condition.

Accordingly, it is a general object of the present invention to provide means for inhibiting unintentional usage of an automobile battery.

More specifically, it is an object of the present invention to provide means for inhibiting automobile drivers from leaving their automobiles with their headlights turned on.

Another object of the invention is to provide a device of the type described which may be easily and comfortably carried in the pockets of automobile drivers.

Another object of the invention is to provide a device of the type described which is economical to manufacture and assemble.

SUMMARY OF THE INVENTION

In a preferred form of the invention, a battery saving key chain is provided for inhibiting unintentional usage of an automobile battery. The key chain comprises a capsule having a tubular member with an open end and a cap member dimensioned to removably close the tubular member open end and thereby define a capsule storage space. A flexible elongated connecting member sized for storage within the capsule storage space loosely connects the cap member with the tubular member. Means are provided for suspending one of the capsule members from an automobile headlight control and for linking an automobile ignition key with the other capsule member.

DETAILED DESCRIPTION OF THE DRAWING

Figure 1:
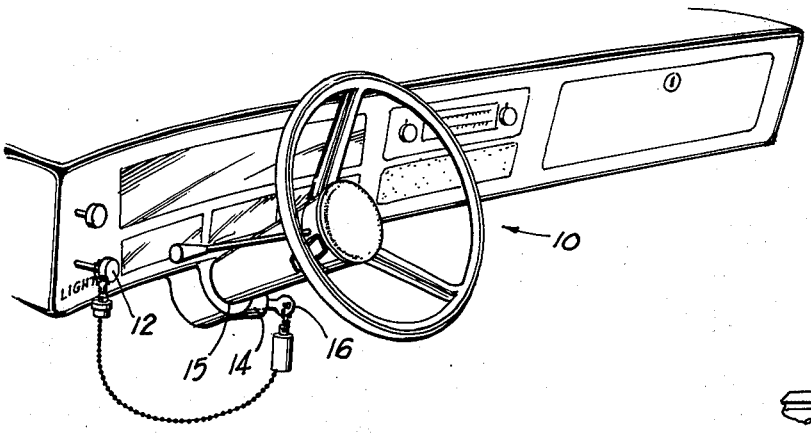
FIG. 1 is a perspective view of an automobile dashboard having a battery saving key chain embodying principles of the invention suspended therefrom.

Referring now in more detail to the drawing, there is shown in FIG. 1 an automobile dashboard 10 having a push/pull type headlight control 12 mounted thereto and an ignition box 14 mounted to the steering wheel column mount 15. A battery saving key chain or ring in accordance with the present invention is seen to be draped from the headlight control with an ignition key 16 inserted into the ignition box.

Figure 2:
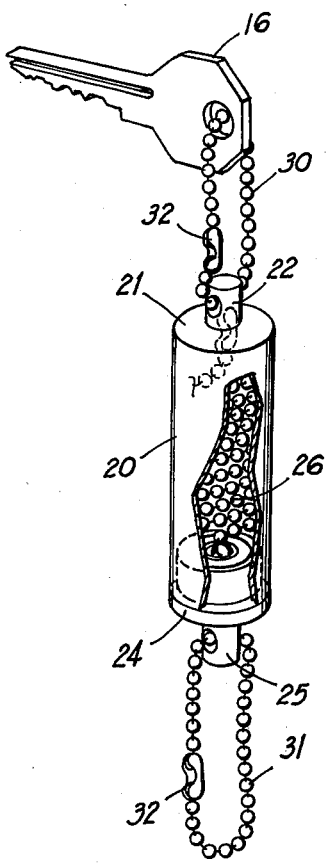
FIG. 2 is a perspective view of the battery saving key chain shown in FIG. 1 illustrated in a stored configuration.
Figure 3:
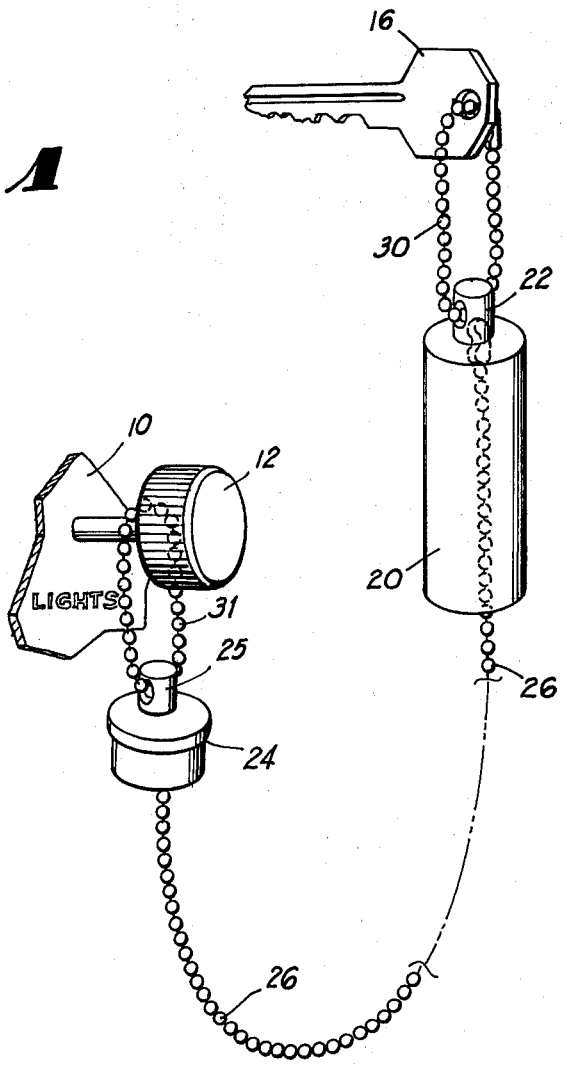
FIG. 3 is another perspective view of the battery saving key chain shown in FIG. 1 depicted in an operative configuration.

With reference next to FIGS. 2 and 3, the battery saving key chain is seen in more detail to include a capsule having a metallic, hollow tubular member 20 having a planar sealed end 21 from which a ferrule 22 projects. The opposite end of the tubular member is open but in this Figure is seen to be temporarily closed by a tubular capsule cap member 24 press fitted into the tubular member open end. The capsule cap is also provided with a ferrule 25 of the same size and shape as ferrule 22 which projects from the closed end 21 of the capsule. A metallic, flexible elongated chain 26 is provided having one end mounted to ferrule 21 inside of the capsule tubular member adjacent end 21 while the other end of the chain is connected to ferrule 25 within the tubular member cap. As shown in FIG. 1, chain 26 is of sufficient length to suspend one of the capsule members from adjacent the automobile ignition box while the other capsule member is suspended from the automobile headlight control. At the same time the length of chain 26 is not so great as to prevent it from being compacted by gravity or hand and stored within the capsule with the capsule cap mounted to the open end of the tubular member as shown in FIG. 2.

With continued reference to FIGS. 2 and 3, two identically sized key chains 30 and 31 are provided with each including an identical coupling member 32 for releasably coupling the ends of each chain together to form a closed loop. Chain 30 is seen here to pass through a channel in ferrule 22 while chain 31 passes through a channel in ferrule 25. Chain 30 is also seen to pass through an opening in the head of key 16 thereby loosely linking the key with the capsule. The other chain 31 is of sufficient size to be draped over the headlight control button and be suspended from the control actuating rod projecting from the button.

In FIG. 2 the battery saving key chain is shown in a stored condition as to be carried in the pocket of an automobile driver while away from a car or other type motor vehicle. In this configuration chain 26 is stored within the capsule. Once the user positions himself in an automobile for driving he may remove the key chain from his pocket and pull the cap member 24 from the open end of tubular member 20. As he does this, chain 26 will be fed out from inside the capsule while still loosely connecting the capsule tubular member with the cap. The ignition key 16 may then be inserted into the ignition box and chain 31 passed over the headlight control button 12 and draped from the control actuating rod. So positioned the key chain assumes the position shown in FIGS. 1 and 3. Once the automobile has been parked, it will be readily apparent that key 16 may not be completely removed from the automobile without deliberately passing chain 32 over the headlight control button. Thus, in the event a driver, as in rainy daylight conditions, should inadvertently park his automobile and remove his key without also removing chain 31 from the headlight control, chain 26 will become taut as the key is carried away from the dashboard. This will serve to provide a jerking action upon the key, thereby alerting the driver to the fact that he is indeed departing his vehicle with his lights on. He may then consciously remove chain 31 from the headlight control and in doing so also consciously move the control to a headlight off position. Following this he may hold the capsule tubular member 20 in an inverted position allowing chain 26 to be fed in by gravity through the open end of the capsule and become housed therewithin. At the end of this process cap 24 may be inserted and press fitted into the open end of the tubular member to reassume the configuration shown in FIG. 2. and the device then pocketed.

It should be understood that the just described embodiment merely illustrates principles of the invention in a preferred form. Many modifications, deletions or additions may, of course, be made thereto without departure from the spirit and scope of the invention as set forth in the following claims.

What is claimed is:

1. A battery saving key chain for inhibiting unintentional usage of an automobile battery comprising a capsule having a tubular member with an open end and a cap member dimensioned to removably close said tubular member open end and thereby define a storage space within said tubular member, a flexible elongated connecting member sized for storage within said storage space loosely connecting said cap member with said tubular member; means for linking an automobile ignition key with one of said capsule members and means for suspending the other of said capsule members from an automobile headlight control while said ignition key is operatively engaged for ignition purposes.

2. A battery saving key chain in accordance with claim 1 wherein said capsule tubular member has a ferrule on the end thereof opposite said open end through which extends said linking means.

3. A battery saving key chain in accordance with claim 2 wherein said capsule cap member is tubular and has a ferrule thereon through which extends said suspending means.

4. A battery saving key chain in accordance with claim 1 wherein said flexible elongated connecting member comprises a metallic chain.

5. A battery saving key chain in accordance with claim 1 wherein said linking means comprises a chain and coupling means for coupling together the chain ends.

6. A battery saving key chain in accordance with claim 1 wherein said suspending means comprises a chain and coupling means for coupling together the chain ends.

* * * * *